United States Patent [19]

Demny

[11] 4,347,725

[45] Sep. 7, 1982

[54] ROLLING BLOCKS

[75] Inventor: Werner Demny, Düsseldorf, Fed. Rep. of Germany

[73] Assignee: Friedrich Kocks GmbH & Co., Hilden, Fed. Rep. of Germany

[21] Appl. No.: 131,058

[22] Filed: Mar. 17, 1980

[30] Foreign Application Priority Data

Apr. 2, 1979 [DE] Fed. Rep. of Germany ..... 2913192

[51] Int. Cl.[3] ..... B21B 31/08; B21B 1/18; B21B 1/00

[52] U.S. Cl. ..... 72/234; 72/249

[58] Field of Search ..... 72/226, 234, 235, 249

[56] References Cited

U.S. PATENT DOCUMENTS

| | | | |
|---|---|---|---|
| 2,757,556 | 8/1956 | Uebing | 72/249 X |
| 3,299,685 | 1/1967 | Kocks et al. | 72/249 |
| 3,595,055 | 7/1971 | Rohde | 72/226 |
| 4,000,637 | 1/1977 | Gerhards et al. | 72/226 |

FOREIGN PATENT DOCUMENTS

| | | | |
|---|---|---|---|
| 588027 | 10/1976 | U.S.S.R. | 72/249 |

OTHER PUBLICATIONS

Brauer, Hans and Bungeroth, Rolf K. "Developments—Rolling Mill Blocks in Modern Kocks Mills" *Iron and Steel Engineer*, vol. 55, No. 1 (Jan. 1978), pp. 55–67.

*Primary Examiner*—Francis S. Husar
*Assistant Examiner*—Jonathan L. Scherer
*Attorney, Agent, or Firm*—Buell, Blenko, Ziesenheim & Beck

[57] ABSTRACT

The stand-to-stand transmission ratios between the working sizing passes at the entry end of a rolling block for rolling bars, rods or wire are fixed but are different from one another. This enables an entire range of finished workpiece cross sections to be obtained from a given first pass workpiece entry cross-sectional area, merely by omitting one or more of the working stands and shifting other working stands from one location to another and by changing only the stands of the finishing sizing passes at the delivery end of the block.

6 Claims, 1 Drawing Figure

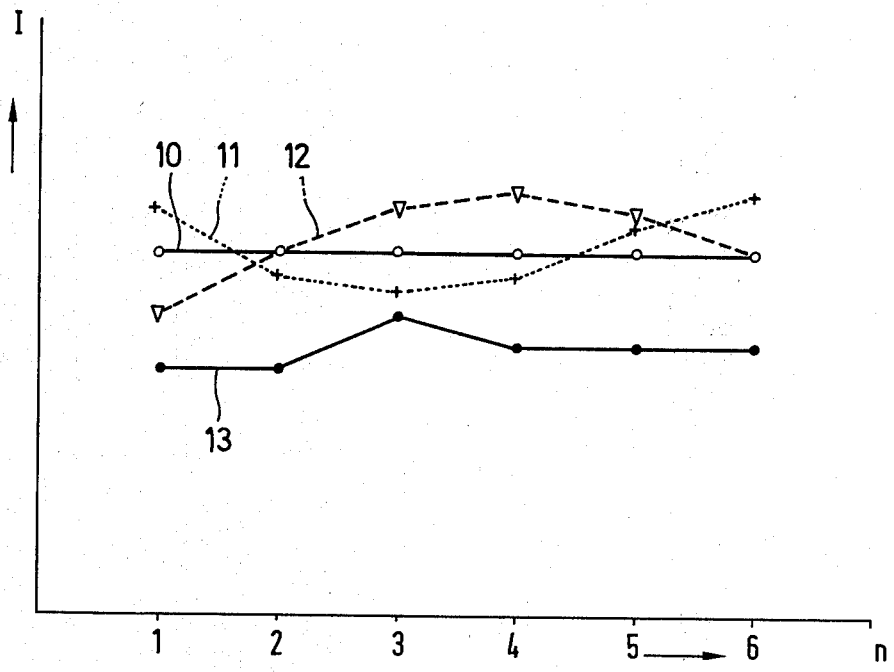
I
10
11
12
13
1
2
3
4
5
6
n

ROLLING BLOCKS

This invention relates to rolling blocks and particularly to a rolling block for the rolling of bars, rods or wire, having a small number of finishing sizing passes at the delivery end which shape the finished cross section with a small amount of reduction, and a larger number of working sizing passes at the entry end which each effect a considerable reduction in the cross section, the rolls of at least the working sizing passes being driven by a common distributor gear by which a fixed transmission ratio from working sizing pass to working sizing pass is provided.

Rolling blocks of this kind have been known for a long time and have been used in a variety of forms with different dimensions. Their working sizing passes, which are disposed at the entry end, therefore effect large reductions in cross section in order to reduce the relatively large first pass entry cross-sectional area in the first instance to approximately the finished cross section. Only the last two or three finishing sizing passes disposed at the delivery end impart the desired finished cross section to the work-material, by, for example, first shaping a bar or length of wire, which is still in the form of an irregular hexagon in the region of the working sizing passes, to a regular hexagon and then to the desired circular finished cross section. The shaping of the irregular hexagonal cross section to the regular hexagonal cross section and finally to the circular cross section is normally performed with a smaller cross-sectional reduction per sizing pass than in the case of the working sizing passes, this also applying analogously to other cross-sectional shapes. Thus, in rolling blocks of this kind, the sizing passes are classified into working sizing passes and finishing sizing passes which can be clearly recognized by their differing cross-sectional shapes and reductions and by their arrangement in the rolling block.

However, the present invention refers only to those rolling blocks in which the working sizing passes are not driven by individual motor, such as separate motors, but are driven by a so-called group drive in which all or several of the working sizing passes of the rolling block are driven by a common motor by way of a distributor gear. In connection with the scope of the present invention, the manner in which the finishing sizing passes are driven is immaterial.

The known rolling blocks of the kind previously described have, in the region of the working sizing passes, distributor gears which not only have fixed transmission ratios from sizing pass to sizing pass, but in which, moreover, the transmission ratios between the adjacent sizing passes are equal. Although one then obtains gear wheels of equal size in the distributor gears, and thus advantages with respect to manufacture, rolling blocks of this kind also have substantial disadvantages which result from the equal transmission ratios in the region of the working sizing passes.

In the case of a specific first pass entry cross-sectional area, and in accordance with the number of working sizing passes which are used, one obtains specific cross sections which then enter the finishing sizing passes, whereby the sizes of the finished cross sections are also determined. Namely, owing to their small cross-sectional reductions, the finishing sizing passes permit only a slight modification of the finished cross sections.

Although slight changes in the finished cross section can still be obtained with a given row of working sizing passes by varying the first pass entry cross-sectional area and/or the diameter of the rolls—and thus the peripheral speeds of the rolls—appreciable changes in the first pass workpiece entry cross-sectional area lead to over-filling or under-filling of the sizing passes, with the known disadvantageous results and, in any case, the diameters of the rolls can only be changed in the case of rolling stands having adjustable rolls.

The possible finished cross sections are otherwise determined solely by the number of rolling working sizing passes, that is to say, the areas of the finished cross sections producible from a first pass workpiece entry cross-sectional area by an existing rolling block differ by exactly the percentage amount which corresponds to the fixed transmission ratios which exist from one working sizing pass to the next following working sizing pass and which are equal to one another in the known constructions. Namely, in order to obtain the next larger finished cross section, the last working sizing pass has to be removed from the rolling block and all the working sizing passes disposed in advance thereof at the entry end have to be moved by one stand location towards the delivery end, whereby the cross-sectional area of the work-material entering the finishing sizing passes is increased by exactly the percentage amount which corresponds to the fixed uniform transmission ratios which exist in the region of the working sizing passes from one working sizing pass to the next following working sizing pass. Furthermore, it will be appreciated that the finishing sizing passes also have to be of correspondingly larger construction. Intermediate sizes cannot be rolled in the case of a specific first pass workpiece entry cross-sectional area and working sizing passes which are predetermined by the first pass workpiece entry cross-sectional area and the fixed transmission ratio. The total reduction results precisely from the total transmission ratio given between the first and the last sizing pass. Since, in the case of variable transmission ratios, the finishing sizing passes are not able to bridge a jump in the cross section corresponding to the reduction by a working sizing pass, and since, in the case of fixed transmission ratios, they can in any case, only roll cross sections on stages of reductions by the working sizing passes, one is restricted with respect to the finished workpiece cross sections obtainable in the known rolling blocks, namely in dependence upon the transmission ratio between the adjacent working sizing passes which has been chosen and which is always the same in the known types of construction.

Nevertheless, if it is desired to produce finished workpiece cross sections with intermediate dimensions, this can only be done in the known rolling blocks by larger changes of 5% or more in the first pass workpiece entry cross-sectional area, which also requires a different row or sizing passes. In addition to the disadvantages involved in changing the rolls, it is then necessary to have various first pass workpiece entry cross-sectional areas available, whereby the entire problem is shifted, say, to a rolling line arranged in advance of the rolling block, since the finished workpiece cross sections of such advance rolling line are the various first pass workpiece entry cross sections to the rolling block. If a casting plant is arranged in advance of the rolling block instead of a rolling line, the casting plant would have to produce various first pass workpiece entry cross-sectional areas, this being uneconomical and expensive.

Moreover, with the same first pass workpiece entry cross-sectional area and the same row of sizing passes in the region of the working sizing passes, it is still possible to produce finished workpiece cross sections with intermediate dimensions when the finishing sizing passes at the delivery end are changed and are provided with a separate drive, whether it be a summing drive, in which a separate variable speed motor output is superimposed on a main fixed speed drive output by means of a summing gear in the form of a differential, or an individual motor-driven drive. However, the possibilities which then offer themselves are inadequate to roll, without gaps in the size range, finished workpiece cross sections of all intermediate dimensions which lie in the region of a row of working sizing passes of the rolling block if the first pass workpiece entry cross-sectional area is also not changed. Furthermore, a rolling block of this kind requires considerable additional expenditure in the separate drive for the finishing sizing passes.

An object of the invention is to provide a rolling block of the kind described initially by which it is possible, with fixed transmission ratios in the region of the working sizing passes, to produce from only one first pass workpiece entry cross-sectional area a required number of finished cross sections of different sizes whose percentage area differences are of differing magnitudes.

In accordance with the invention there is provided a rolling block for the rolling of bars, rods or wire, having a small number of finishing sizing passes at the delivery end which shape the finished cross section with a small amount of reduction, and a larger number of working sizing passes at the entry end each of which effects a relatively large reduction in the cross section, the rolls of at least the working sizing passes being driven by a common distributor gear in which a fixed transmission ratio from working sizing pass to working sizing pass is provided, the fixed transmission ratios between the adjacent working sizing passes being of differing magnitudes.

Differing transmission ratios between the adjacent working sizing passes were hitherto provided only between the last working sizing pass and the first finishing sizing pass or between the finishing sizing passes themselves, whereas the transmission ratios between the individual working sizing passes were always the same. However, if differing transmission ratios are chosen in accordance with the invention, this renders it possible to produce an entire range of finished workpiece cross sections without changing the first pass workpiece entry cross-sectional area and without a separate drive in the region of the finishing sizing passes (which might possibly be additionally used), only the finishing sizing passes having to be changed.

Only one or several of the working sizing passes are omitted in each case, and the sizing passes arranged in advance thereof at the entry end are shifted towards the delivery end within the rolling block, it being possible to do this rapidly and without difficulty by shifting the readily interchangeable rolling stands to another stand location. Advantageously, no changes are required in the region of the drive. Individual drives and expensive control devices can be omitted. Moreover, in the rolling block in accordance with the invention, there is in many cases a saving on one or two sizing passes and the associated rolling stands and stand locations compared with rolling blocks of conventional construction, thus substantially reducing the prime costs and spatial requirements. By way of example, if the largest finished workpiece cross section required is to be obtained from a specific first pass entry cross-sectional area in three sizing passes each effecting a 20% reduction in cross section, only a 20% reduction in cross section would be possible in each stand location in the known construction having equal transmission ratios along the entire rolling block. By way of example, the known construction would then require seven sizing passes for the smallest finished cross section required. With a rolling block designed in accordance with the invention, the same smallest finished cross section could be obtained from the same first pass workpiece entry cross-sectional area by using only six sizing passes by choosing different transmission ratios between the working sizing passes, in the present example by providing a 26% reduction of cross section in each of three sizing passes and a 20% reduction in each of the other three sizing passes, and varying the transmission ratios by the same percentage amount. A further advantage resides in the fact that, compared with the known constructions, the rolling block in accordance with the invention can produce a larger number of finished workpiece cross sections with a smaller number of first pass workpiece entry cross-sectional areas.

Consequently, the rolling block in accordance with the invention is suitable for extending the range of application of the single rolling blocks having fixed transmission ratios. A characteristic of this range of application is that, in the rolling block in accordance with the invention, the average reduction in cross-sectional area (calculated from the number of working sizing passes used and the associated cross-sectional reductions of the same without the first working sizing pass) are not constant or substantially constant as in the known constructions, but that they are dependent upon the number of rolling working sizing passes and their arrangement in the rolling block. If, for example, there is a series of transmission ratios which increase from the entry end to the delivery end, the reduction of the cross section obtained by a specific number of working sizing passes, if these working sizing passes continue to be used at the delivery end of the rolling block, will be greater than that obtained if the same number of working sizing passes continued to be used at the entry end.

The transmission ratios from working sizing pass to working sizing pass in the rolling direction can be larger or smaller than the preceding transmission ratio by an equal amount. Furthermore, the transmission ratios from working sizing pass to working sizing pass in the rolling direction can be larger or smaller than the preceding transmission ratio in accordance with a curve. This curve can have maximum values or minimum values or both. Alternatively, in another embodiment of the invention, the transmission ratios from working sizing pass to working sizing pass can differ from one another by a regular amount. Finally, it is also conceivable for the transmission ratios of the working sizing passes to vary in a group-wise manner and to be the same or differ from one another within the group. The manner in which the transmission ratios are effected depends entirely upon the finished cross sections required.

The invention is further described, by way of example, with reference the accompanying drawing illustrating a graph relevant to several embodiments of the invention.

The six stand locations at the entry end of a rolling block for rod or wire have thereon respective working sizing passes. These are designated 1 to 6 along the abscissa, although a different number of working sizing passes is conceivable. In order to simplify the drawing, and since they are not the subject of the present invention, the stand locations for the finishing sizing passes have been omitted. The various magnitudes of the stand-to-stand transmission ratios are plotted along the ordinate, but without specific numerical values, since they can be chosen from a wide range.

The line 10 connects the transmission ratios in a rolling block of known construction, and it will be clearly seen that all the transmission ratios are equal. The connection lines 11 and 12 characterise two series of transmission ratios of two rolling blocks in accordance with the invention in which the transmission ratios from stand location to stand location differ. The line 13 connects the transmission ratios of a further rolling block in accordance with the invention in which the transmission ratios are equal in groups. In this embodiment, the stand locations 1 and 2 form the first group, whereas the stand locations 4, 5 and 6 form the second group. The stand location 3 has a transmission ratio of exceptional magnitude.

It will be appreciated that many other transmission ratios can be used in addition to those illustrated, and that alternatively, combinations of the embodiments of the invention claimed can be used at any time. Also the graph assumes that all the rolls have the same diameter. This will generally be the case, although the invention is not so limited.

In the foregoing specification certain preferred embodiments and practices of this invention have been set out, however, it will be understood that this invention may be otherwise embodied within the scope of the following claims.

I claim:

1. A rolling block for the rolling of bars, rods, or wire, having a small number of finishing sizing passes at the delivery end which shape the finished cross section with a small amount of reduction, and a larger number of working sizing passes at the entry end each of which effects a relatively large reduction in the cross section, the rolls of at least the working sizing passes being driven by a common distributor gear assembly in which a fixed transmission ratio from working sizing pass to working sizing pass is provided, the fixed transmission ratios between the adjacent working sizing passes being of differing magnitudes such that positive roll speed ratios from sizing pass to sizing pass of said working sizing pass at the entry end are provided.

2. A rolling block as claimed in claim 1, in which the transmission ratios from working sizing pass to working sizing pass in the rolling direction are larger or smaller, by an equal amount, than the preceding transmission ratio.

3. A rolling block as claimed in claim 1, in which the transmission ratios from working sizing pass to working sizing pass in the rolling direction are larger or smaller, in accordance with a curve, than the preceding transmission ratio.

4. A rolling block as claimed in claim 1, in which the transmission ratios from working sizing pass to working sizing pass differ from one another by an irregular amount.

5. A rolling block as claimed in claim 1, in which the transmission ratios of the working sizing passes vary in a group-wise manner and are equal to one another or different from one another within the group.

6. A rolling block for the rolling of bars, rods or wire as claimed in claim 1, wherein at least one of the working sizing passes can be omitted during a rolling regimen to vary the finished workpiece cross section.

* * * * *